US005441148A

United States Patent [19]

Appleton

[11] Patent Number: 5,441,148

[45] Date of Patent: Aug. 15, 1995

[54] RELEASE MECHANISM FOR CANS

[76] Inventor: Arthur J. Appleton, 61 Eagle Lake La. #31, San Ramon, Calif. 94583

[21] Appl. No.: 257,682

[22] Filed: Jun. 9, 1994

[51] Int. Cl.[6] ..... B65D 75/00

[52] U.S. Cl. ..... 206/150; 206/151; 294/87.2

[58] Field of Search ..... 206/150, 151, 158; 294/87.2

[56] References Cited

U.S. PATENT DOCUMENTS

| | | | |
|---|---|---|---|
| 3,038,602 | 6/1962 | Rapata | 294/87.2 |
| 3,504,790 | 4/1970 | Owen | 206/65 |
| 4,064,989 | 12/1977 | Olsen | 206/428 |
| 4,518,081 | 5/1985 | de Larosiere | 206/158 |
| 4,550,824 | 11/1985 | Rhoads | 206/150 |
| 5,016,750 | 5/1991 | Gordon | 206/150 |
| 5,174,441 | 12/1992 | Marco | 206/150 |
| 5,178,266 | 1/1993 | Villa | 206/150 |
| 5,193,673 | 3/1993 | Rathbone et al. | 206/150 |
| 5,209,346 | 5/1993 | Pratt et al. | 206/150 |
| 5,255,780 | 10/1993 | Olsen | 206/150 |
| 5,265,718 | 11/1993 | Marco | 206/150 |
| 5,269,406 | 12/1993 | Olsen et al. | 206/150 |

*Primary Examiner*—David T. Fidei
*Attorney, Agent, or Firm*—Bielen, Peterson & Lampe

[57] ABSTRACT

A release mechanism for multiple containers forming a row between first and second portions utilizing a band of resilient material. The band extends about a portion of the periphery of each of the multiple containers and forms a closed loop about the entirety of the containers. The closed loop exerts a force on each of the multiple containers. A frangible element is formed along the loop. In addition, the release mechanism includes a connecting member located along the row between the first and second portions of the multiple containers. The connecting member includes a plurality of frangible elements linking the connecting member to the band in order to form a breakable collar about each of the multiple containers. A flange or tab is also included in the present invention for permitting the application of a pulling force on the connecting member to separate any selected number of frangible elements linking the connecting member to the band to free the containers.

7 Claims, 2 Drawing Sheets

RELEASE MECHANISM FOR CANS

BACKGROUND OF THE INVENTION

The present invention relates to a novel and useful release mechanism for multiple containers adjacent to one another.

Many container packaging systems have been devised to hold cans or bottles in a four-pack, six-pack, or the like. In the past, sleeves made of a paper or cardboard have been devised to create a pocket to support such items.

In more recent times, plastic matrices having a plurality of rings or collars have been employed to hold the individual cans or bottles together and permit the release of the same by the use of perforations or slits.

U.S. Pat. Nos. 3,504,790, 4,064,989, 4,518,081, 5,016,750, 5,178,266, 5,193,673, 5,209,346, 5,255,780, 5,265,718, and 5,269,406 describe this general system of holding cans or bottles together in a pack.

Unfortunately, the tabs or pulls devised with such containers are not always employed leaving closed rings which are considered to be environmentally unsafe.

A release mechanism for multiple containers which leaves an open remnant would be a notable advance in the field of packaging.

SUMMARY OF THE INVENTION

In accordance with the present invention a novel and useful release mechanism for multiple containers is herein provided.

The release mechanism of the present invention utilizes a band of resilient material which extends about at least a portion of the periphery of a multiple number of containers. The containers are normally arranged to form a channel between first and second rows thereof. The band forms a closed loop about the entirety of the multiple containers such that the closed loop exerts a force on each of the multiple containers to hold the same in slight compression. Thus, the band of resilient material and the closed loop formed from the same may be used to carry the containers. The closed loop formed from the band of resilient material possesses at least one frangible element along its length.

The present invention also includes a connecting member formed of flattened material which is compatible with the band of resilient material. In most cases, the connecting member will be constructed of the same material as the band of resilient material. The connecting member locates along the space or channel between the first and second portions of the multiple containers. The connecting member is formed with a plurality of frangible elements linking the connecting member to the band in order to form a breakable collar about each of the multiple containers. Each breakable collar also exerts an inward force on each container.

Grasping means may be also found in the present invention to permit the application of a pulling force by the user on the connecting member. Thus, pulling of the connecting member may separate any of the frangible elements linking the connected member to the band, resulting in the release of any or all of the containers held together in the package. In addition, a tab may be formed on the band to permit an alternate method of releasing selected containers by pulling the tab about the periphery of the closed loop. The frangible portion on the closed loop, in any case, forms a remnant which is not a closed loop. Thus, the release mechanism of the present invention is not a hazard to wildlife and the like.

It may be apparent that a novel and useful release mechanism for multiple containers has been described.

It is therefore an object of the present invention to provide a release mechanism for multiple containers which eventually forms a waste remnant which contains no closed collars or loops of any sorts.

Another object of the present invention is to provide a release mechanism for multiple containers which is considered to be environmentally safe especially with respect to water fowl and other wildlife.

Another object of the present invention is to provide a release mechanism for multiple containers which is easy to manufacture and to use.

A further object of the present invention is to provide a release mechanism for multiple containers which permits the user to selectively release any or all of the containers by a pulling force on a central connecting member.

Yet another object of the present invention is to provide a release mechanism for multiple containers which includes alternate mechanisms for releasing any or all of the containers and thus permits release of the containers in the mechanism at various access points.

The invention possesses other objects and advantages especially as concerns particular characteristics and features thereof which will become apparent as the specification continues.

Figure 1:
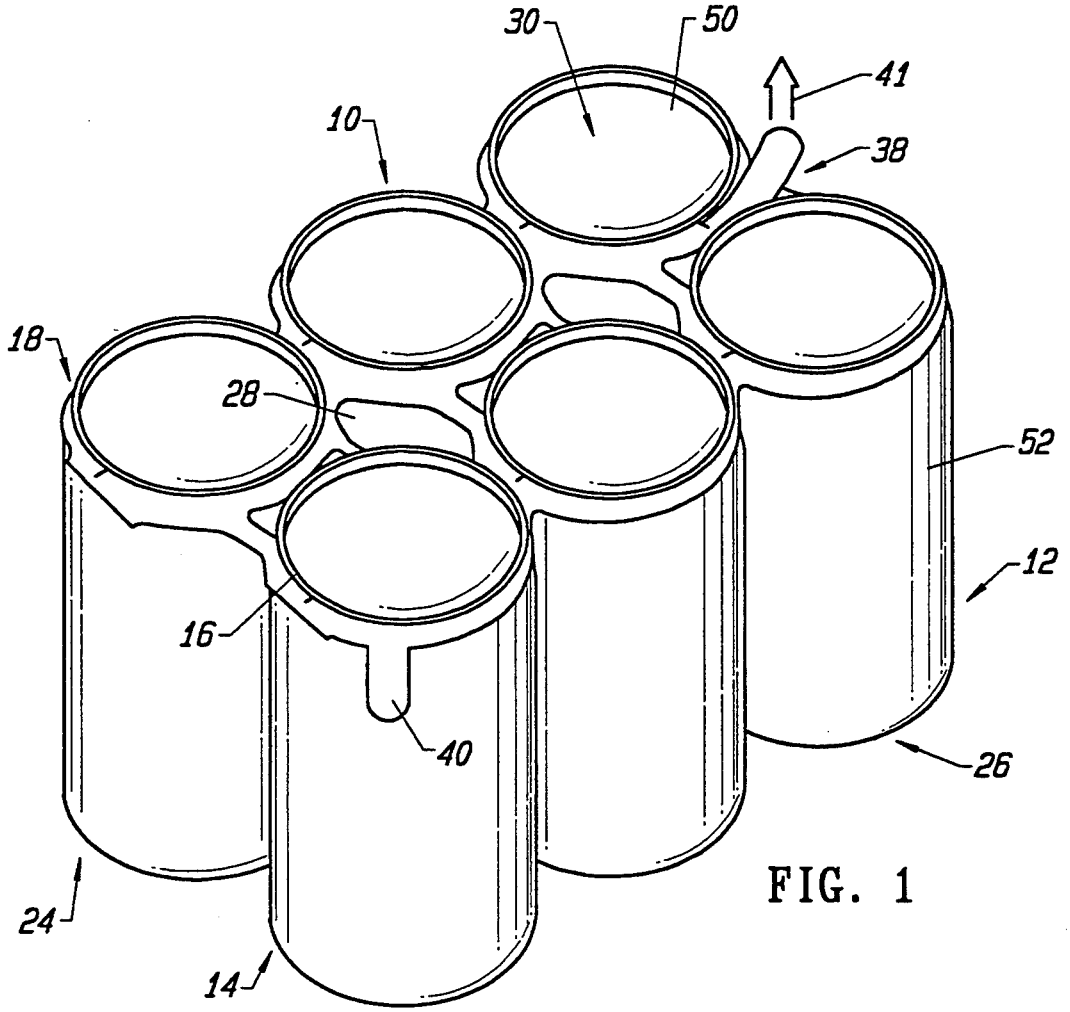
FIG. 1 is a top right perspective view of the release mechanism of the present invention formed into a package for a six-pack of cans.

For a better understanding of the invention reference is made to the following detailed description of the preferred embodiments thereof which should be referenced to the herein above described drawings.

DETAILED DESCRIPTION OF THE PREFERRED EMBODIMENTS

Various aspects of the present invention will evolve from the following detailed description of the preferred embodiments thereof which should be taken in conjunction with the prior described drawings.

The invention as a whole is depicted in the drawings by reference character 10. The release mechanism 10 serves as a holder for a multiplicity of containers 12 which are shown in the drawings as six identical cans. Exemplar can 14 is typically constructed of metallic material such as aluminum, and includes a circular flange or rim 16 at the top portion thereof. Of course, multiplicity of containers 12 may be in the form of bottles constructed of ceramic material or glass and the like. Release mechanism 10 is composed of a band 18 of resilient material such as plastic, paper, an elastomeric composition, or combinations of the same, FIGS. 1 and 2. Band 18 possesses a plurality of arches 20 that are intended to extend about at least a portion of the periphery of multiplicity of containers 12. When each of the multiplicity of containers 12 are fit into band 18, a closed loop 22 is formed about containers 12. Closed loop 22 is sized such that the arrangement of containers 12 arranged into a first portion or row 24 and a second portion or row 26, creates a space or channel 28 therebetween.

Connecting member 30 locates along space 28 between first and second portions 24 and 26 of multiplicity of containers 12. Connecting member 30 includes a plurality of frangible elements 32 linking connecting member 30 to band 18. Such linkage creates a plurality of breakable collars 34 that squeeze each of the multiplicity of containers 12. Frangible elements 32 are depicted in the drawings as a series of slits. However, frangible elements 32 may take the form of perforations, discontinuities in thickness between band 18 and connecting member 30, or any other weakened zone which permits the removal of connecting member 30 from band 18, which will be described in detail hereinafter. Connecting member also includes a number of openings or apertures 36 in the central region thereof to be used as finger holes or to lighten mechanism 10. It should be noted that frangible element 37 is located on closed loop 22.

Grasping means 38 is depicted in the form of an appendage which extends outwardly from connecting member 30. Grasping means 38 permits the user of mechanism 10 to exert a pulling force on connecting member depicted by directional arrow 41, FIG. 1. In addition, a tab 40 may be constructed as an appendage to band 18. With reference to FIG. 2, tab 42 is also shown in phantom indicating that tab 40 may be used in conjunction with tab 42 or as an alternative to tab 42.

Figure 2:
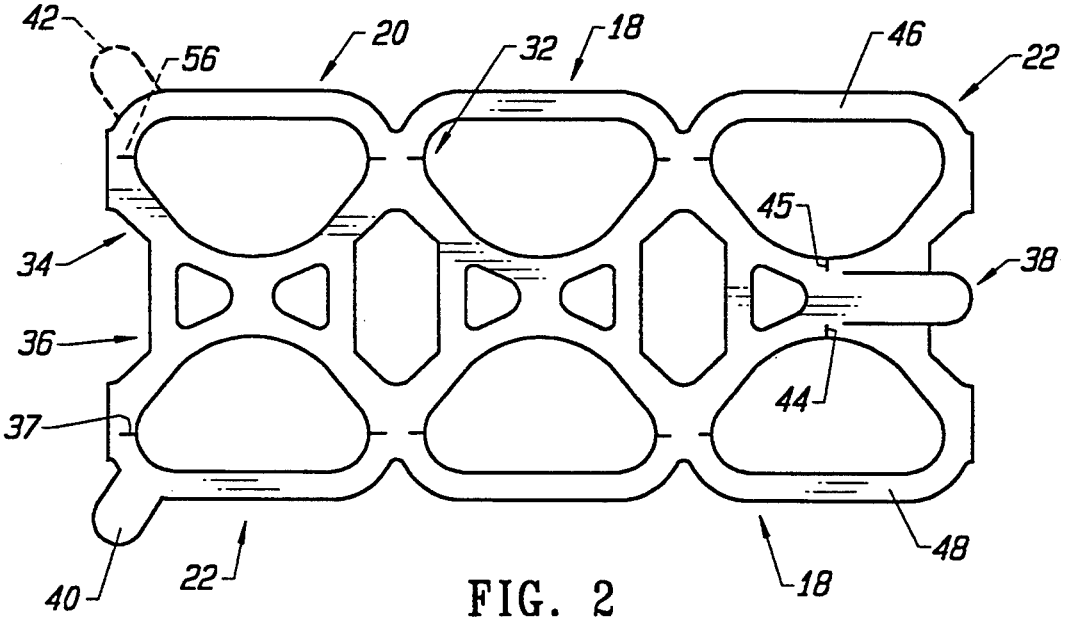
FIG. 2 is a top plan view of the release mechanism of the present invention.
Figure 3:
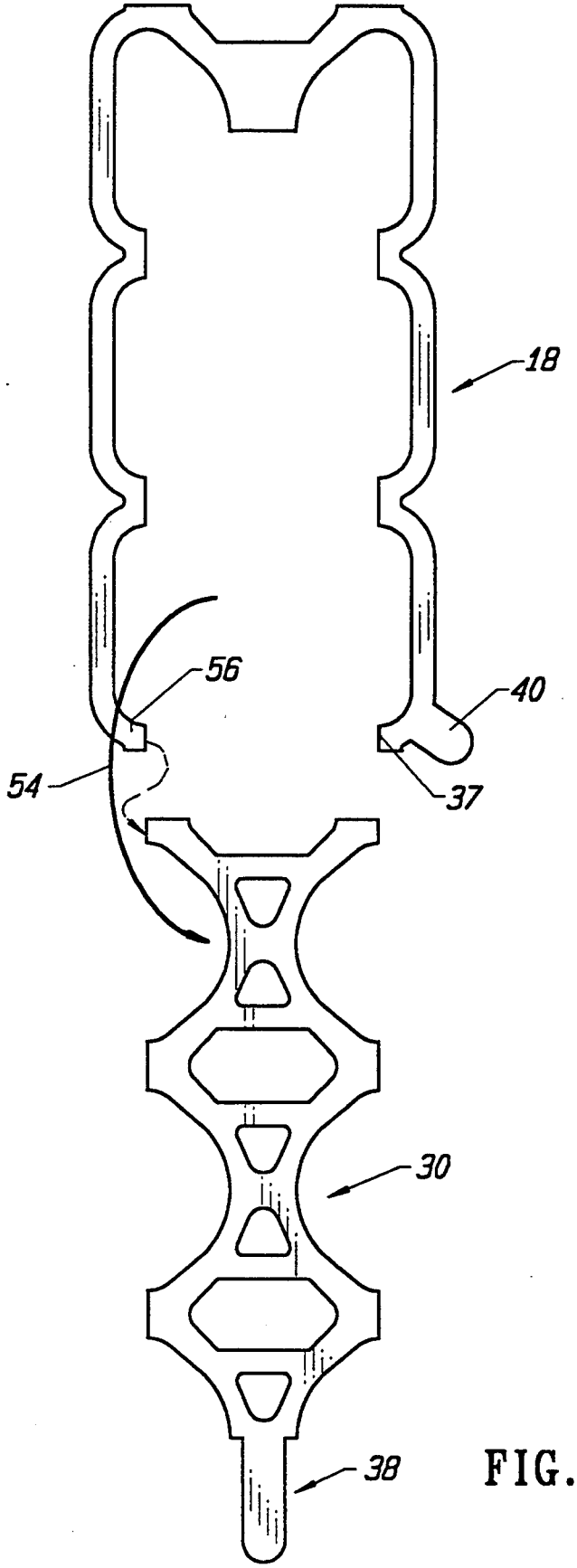
FIG. 3 is a top plan view of the release mechanism of the present invention depicting the central connecting member separated from the band of resilient material forming the periphery of the cans.

In operation, with reference to FIGS. 1 and 3, the user pulls tab 38 of connecting member 30 upwardly and toward tab 40 on band 18. Turning to FIG. 2, it may be seen that frangible elements 44 and 45 break open collars 46 and 48 about containers 50 and 52, respectively. Further pulling of tab 38 toward tab 40 will result in the opening of all of the plurality of breakable collars 34 releasing all of the containers 12 from mechanism 10. FIG. 3 represents the complete removal of connecting member 30 from band 18, including the breaking of frangible element 37. Directional arrow 54 indicates the removal motion of connecting member 30 relative to band 18. It should be noted that plurality of containers 12 are not shown on FIG. 3 for the sake of clarity. Frangible element 56, FIG. 2, has also been depicted as being completely severed, i.e., such that connecting member 30 and band 18 are completely separated. In certain cases, frangible element 56 may not be necessary as long as closed loop 22 becomes an open loop by the breaking of frangible element 37. Moreover, tabs 40 or 42 may be employed to move around the perimeter of band 18 and successively break or sever frangible elements 32 beginning with frangible elements 37 or 56, respectively. The depiction in FIG. 3 would be identical whether grasping means 38, tab 40, or tab 42 has been used to release multiplicity of containers 12. In any case, the remnants of mechanism 10 depicted in FIG. 3, contain no closed loop in the form of collars or an integral closed loop 22 originally formed by connecting member 30 and band 18.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A release mechanism for a multiple container package having a space between first and second portions of the multiple containers comprising:

a. a band of resilient material extending about at least a portion of the periphery of each of the multiple containers, said band forming a closed loop about the entirety of the multiple containers, said closed loop exerting a force on each of the multiple containers, said closed loop possessing at least one frangible element therealong;

b. a connecting member located along the space between the first and second portions of the multiple containers, said connecting member including a plurality of frangible elements linking said connecting member to said band to form a breakable collar about each of the multiple containers; and c. grasping means for permitting the application of a pulling force on said connecting member to separate any of said frangible elements linking said connecting member to said band, and to separate said closed loop of said band at said one frangible element therealong.

2. The release mechanism of claim 1 which further comprises a second frangible element along said closed loop.

3. The release mechanism of claim 1 in which said band further comprises a tab.

4. The release mechanism of claim 3 in which said grasping means further permits the application of a pulling force on said tab to separate said closed loop at said one frangible element.

5. The release mechanism of claim 3 which further comprises a second frangible element along said closed loop.

6. The release mechanism of claim 4 in which said grasping means further permits the application of a pulling force on said tab to separate said closed loop at said second frangible element.

7. A release mechanism for a multiple container package having a space between first and second portions of the multiple containers comprising:

a. a band of resilient material extending about at least a portion of the periphery of each of the multiple containers, said band forming a closed loop about the entirety of the multiple containers, said closed loop exerting a force on each of the multiple containers, said closed loop possessing at least one frangible element therealong;

b. a connecting member located along the space between said first and second portions of the multiple containers, said connecting member including a plurality of frangible elements linking said connecting member to said band to form a breakable collar about each of the multiple containers; and c. grasping means for permitting the application of a pulling force on said connecting member to separate any of said frangible elements linking said connecting member to said band and any breakable collars about any of said multiple containers, thereby.

* * * * *